United States Patent [19]

Feast et al.

[11] Patent Number: 4,997,000

[45] Date of Patent: Mar. 5, 1991

[54] WETSUIT WASHING AND DRYING ASSEMBLY AND METHOD

[76] Inventors: Vance C. Feast, 1061 Tiller, Incline Village, Nev. 89450; Marcus A. Leo, 1248 Castro Rd., Monterey, Calif. 93940

[21] Appl. No.: 443,551

[22] Filed: Nov. 29, 1989

[51] Int. Cl.[5] ..... B08B 3/02

[52] U.S. Cl. ..... 134/170; 134/115 R; 134/102; 134/200; 134/201; 239/36; 239/425

[58] Field of Search ..... 134/166 R, 170, 171, 134/102, 198, 115, 200, 201; 34/106; 223/85, 86, 92; 239/36, 435; 68/205 R

[56] References Cited

U.S. PATENT DOCUMENTS

| | | | |
|---|---|---|---|
| 2,303,313 | 12/1942 | Abbens | 223/86 |
| 2,461,149 | 2/1949 | Ericson | 223/86 |
| 3,511,252 | 5/1970 | Kennedy | 134/170 X |
| 3,620,234 | 11/1971 | Everroad | 134/170 X |
| 4,354,514 | 10/1982 | Sundheimer et al. | 134/170 X |
| 4,381,016 | 4/1983 | Douglas et al. | 134/170 |
| 4,592,497 | 6/1986 | Georges | 223/85 |
| 4,653,275 | 3/1987 | Clifford | 68/205 R |
| 4,729,394 | 3/1988 | Timmes et al. | 134/199 |
| 4,762,139 | 8/1988 | Timmes et al. | 134/201 X |
| 4,949,739 | 8/1990 | Ryan | 134/115 |

FOREIGN PATENT DOCUMENTS

| | | | |
|---|---|---|---|
| 1261277 | 4/1961 | France | 223/86 |

*Primary Examiner*—Frankie L. Stinson
*Attorney, Agent, or Firm*—The Dulin Law Firm

[57] ABSTRACT

An apparatus and method for washing and drying (cleaning) a wetsuit. The system employs a two-tiered, fluid piping structure having an upper and lower hanger portions. The upper hanger portion is directly or indirectly connected to a hose which is connectable to a water or/and air source. During washing and rinsing operations, the appropriate liquid is introduced through the hose into the hanger portions, and is driven through a plurality of spray heads disposed selectively on both upper and lower hanger portions. The individual spray heads are oriented to overlappingly spray the entire outside and inside surfaces of the wetsuit. In a commercial embodiment, two or more systems are connected in series along a common horizontal tube. The entire unit is suspended and housed within a special enclosure. Quick connectors and/or on/off flow valves or disposed along the common connector tube between adjacent units to aid in controlling fluid flow into the desired number of systems to be used during a giving cleaning operation. The lower hanger is connected to the upper by a valved quick connector so it can be released from the upper hanger and suspended from a separate fitting remote from the upper hanger to drain dry, sun dry or dry by forced air blowers external to the suit or through the hanger piping and spray heads.

31 Claims, 3 Drawing Sheets

WETSUIT WASHING AND DRYING ASSEMBLY AND METHOD

FIELD

The invention relates generally to method and apparatus for washing, drying and care of wetsuits. The invention relates particularly to a method and apparatus for quick and water-efficient washing and drying of both the inside and outside of a wetsuit with minimal handling.

BACKGROUND

Wetsuits are used to provide thermal protection against the numbing effects of cold water and wind for a wide range of water sports and activities, including, but not limited to, surfing, sailing, windsurfing, scuba diving and the like. Modern day wetsuits, being constructed of neoprene and laminated nylon fabrics, provide thermal protection by forming a second 'thin skin' around the user. This second skin permits a small amount of water to accumulate between itself and the user, which is then warmed to a comfortable temperature by the heat radiating from the user's body. The neoprene also has a "foam" or closed cell nature which provides some insulating characteristics.

A properly fitted wetsuit, in good condition, permits the entry of a minimal amount of water necessary to achieve this additional thermal insulating layer. Wetsuits that are ill fitting, or that become ripped or torn due to premature aging, or through improper care, become ineffective against the effects of cold wind and water by allowing an excess amount of water to continuously contact the user's skin. This "flushing" effect quickly chills the user as the moving cold water conducts body heat away from the user's skin as compared to the user being warmed by the trapped radiant body heat when the water is held relatively stationary next to the skin by the wetsuit. Thus, it is important to properly care for a wetsuit so that it can provide the best possible thermal protection.

Wetsuits are exposed to salt water, urine, stale water, sand, and other foreign objects and must be cleaned with fresh water after every use or else they begin to deteriorate and lose their thermal protection qualities. In addition to corrosive effects of salt water, another cause of deterioration of the neoprene is due to the proliferation of the fungus and bacteria by the contamination from stale water.

In addition to the problems of deterioration due to poor cleaning techniques, other problems associated with odor, bacteria and fungal growth may arise, and thereby create a health hazard to the consumer, as well as cut short the life of the wetsuit.

Thus, if the wetsuit has not been washed and dried properly health hazards are likely to result from skin contact with the resultant fungal and bacterial growth inside the wetsuit or interstially in the pores and cells of the neoprene. Skin disorders and other infections can be transmitted from one wetsuit wearer to the next. These problems are compounded in a commercial setting, such as in a Dive or Surf Shop operation where wetsuits are regularly being rented out to different users over prolonged periods of time. This presents a serious liability problem to the rental shop owner. Therefore, inadequate care and cleaning of the wetsuit not only compromises the wetsuit's life and insulation properties, but also the health of the user.

Moreover, sand and other foreign objects which have not been washed from the interior and exterior surfaces of the wetsuit may cause skin abrasions, irritation and discomfort to the user. More serious health complications may arise, since broken skin provides a convenient pathway for any fungal or bacterial invasion of the user's skin or immune system.

A wet wetsuit is a chore to put on. When it has not been dried properly, it clings to the user's skin and is susceptible to tearing when being put on. Changing into a wet or slightly wet wetsuit, especially early in the morning, is very uncomfortable, not to mention cold and clammy feeling to the user. The user starts out chilled, and may develop a varying degree of hypothermia, in itself a dangerous condition, but also one that leads to torn muscles, cramps, and the like.

Wetsuits are normally cleaned with fresh water from a garden hose, shower, or bucket; however, these methods are not thorough. Neoprene is porous, much like a sponge, and will hold salt water, urine, or stale water until thoroughly washed. Some users of wetsuits attempt to wash their wetsuits by wearing them in the shower. This, however, is an objectional practice as seen by most other users of the shower facilities, since saltwater, sand, seaweed and associated debris is usually tracked into the house and shower room when the wetsuit is washed in this manner. In addition, wetsuits take a long time to dry if left hanging in the humid atmosphere of the shower.

All methods of washing and drying wetsuits heretofore known suffer from a number of disadvantages. Because of the numerous steps required by the consumer to wash and dry wetsuits and because of the difficulty in accomplishing a complete and thorough washing, most wetsuits receive inefficient and incomplete care.

Accordingly, there is a need in the art for a wetsuit washing and drying apparatus which thoroughly washes the wetsuit to remove any saltwater, urine, stale water, sand or other foreign objects from the porous neoprene material. There is also a need in the art for a wetsuit drying apparatus which quickly prepares the wetsuit for its next use, and insures no long period of dampness which encourages bacterial and fungal growth.

THE INVENTION

OBJECTS

It is an object of the present invention to provide a wetsuit washing and drying device and method which thoroughly washes and dries both the inside and outside surfaces of a wetsuit simultaneously.

It is another object of the present invention to provide a wetsuit washing and drying system which is both water and energy efficient, easy to use, and is particularly useful for commercial wetsuit rental shops.

It is still another object of the present invention to provide a wetsuit washing and drying system which removes residual saltwater, urine, stale water, and other similar corrosive and deteriorative elements from the pores and surfaces of the wetsuit material thereby significantly reducing wetsuit deterioration and premature aging of a wetsuit.

It is still another object of the present invention to provide a wetsuit washing and drying system which thoroughly removes sand and other foreign objects from the wetsuit material thereby tending to reduce skin disorders and other discomforts to the user associated therewith.

It is still another object of the present invention to provide a wetsuit washing and drying system which reduces odors, fungal and bacterial growth by thoroughly removing the contributing agents from the wetsuit material.

It is still another object of the present invention to provide a wetsuit washing and drying system which drys a wetsuit quickly to eliminate bacterial and fungal moisture conditions, but without the premature aging effects of direct sunlight.

It is still another object of the present invention to provide a wetsuit washing and drying system which drys a wetsuit thoroughly for comfortable and easy entry for the user.

It is still another object of the present invention to provide a wetsuit washing and drying system which can universally accommodate all wetsuit entry designs.

Still other and further of the present invention will be evident from the following specification, drawings and claims.

DRAWINGS

FIGS. 1 and 2 are front elevation views of a first embodiment of the wetsuit washer and drying assembly of this invention showing the disconnectability of the top and bottom hanger portions by use of a quick connect fitting. In FIG. 1, the top and bottom hanger portions are disconnected from each other. In FIG. 2, the top and bottom hanger portions are fully connected.

Figure 1:
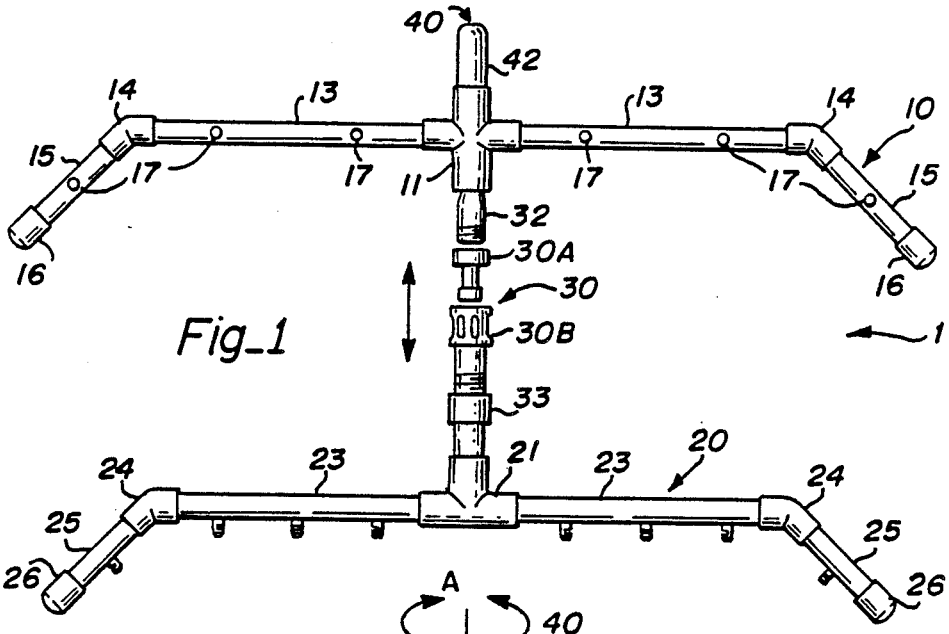

FIG. *7a* is a perspective view of a second embodiment of this invention showing a commercial system having multiple wetsuit washing and drying capability.

FIG. *7b* is a perspective of another embodiment of the manifold assembly for a commercial wetsuit washing/drying system of this invention.

SUMMARY

The present invention comprises an apparatus and method, together called a system, for thorough, quick and convenient washing and drying of a wetsuit. The apparatus comprises a multiple-tiered fluid piping structure, preferably two-tiered, which is connectable to either or both a water or/and an air source. The piping structure acts as both a structure for supporting and retaining a wetsuit in a position for cleaning and as a conduit for the cleaning fluid (wash solution, fresh water rinse, and air dry) to be sprayed over both the interior and exterior surfaces of the wetsuit. The piping structure preferably includes similarly-shaped top and bottom hanger portions which are interconnectable by a quick connect/disconnect member at a medially-disposed cross-fitting of each hanger portion member.

Each of the upper and lower cross fittings of the top and bottom hanger portions have connected thereto and extending laterally outward therefrom, a pair of opposed, horizontal hollow arms, preferably pipe members, that are each further joined to downwardly sloping, shorter pipe members by means of a 45 degree pipe fitting. Cap members are used to plug the free outer ends of the shorter, downwardly sloping pipe members of each hanger portion.

The bottom hanger portion is dimensioned and structurally strong enough to support a wet wetsuit, hanging such that the longer horizontal pipe members support the neck and shoulder area of the wetsuit while the shorter, downwardly sloping pipe members support the arms of the wetsuit, suspending the arms outward and away from the sides of the wetsuit torso. This permits a thorough cleaning of all outer surface areas of the wetsuit arms. Spray heads are positioned at selected, preferably regular, intervals along the underside of the pipes of the bottom hanger portion. The spray heads, each having a spray directing mouth, are selectively oriented to create a spray pattern sufficient to cover, in an overlapping pattern, the entire inside of the wetsuit when in the bottom hanger portion is used to support the wetsuit. The inside diameter sizing and orientation of the piping system of the bottom hanger portion is volumetrically sufficient to deliver a constant strong fluid spray from the spray heads under normal fluid pressure conditions without undue pressure loss due to friction.

The dimensions of the top hanger portion are substantially identical to those of the bottom hanger portion. Preferably this top hanger portion has a U-shaped hose-connecting unit disposed medially along the top of the upper cross-fitting, and preferably having slightly longer horizontal pipe members to permit a wider range of spray coverage for the outside of the wetsuit when positioned on the lower hanger member. Members of a first set of spray heads are positioned at regular intervals along a first, front facing surface of the horizontal and downwardly sloping pipe members, each having a spray directing mouth oriented downward to create a spray pattern sufficient to overlappingly cover the entire outside front surface of the wetsuit. A second set of spray heads, preferably coordinate with the first set, are disposed along the back facing surface of the pipes and are oriented to direct a spray pattern sufficient to cover the entire back surface area of the wetsuit.

In operation, the wetsuit is hung from the bottom hanger portion and the zipper of the wetsuit (if any) is zipped up. The bottom hanger portion is then connected via the quick connector to the top hanger portion which is suspended by any convenient means, e.g. a pair of wire hangers, elevated from the floor a distance greater than the shoulder to ankle length of the wetsuit. The top hanger portion is connected to a water source by the hose connecting unit. The water, prefer conta a soap and anti-bacterial/anti-fungal agent, (such as hexachloraine) is then turned on, resulting in water spraying out of the spray heads with great force, removing residual salt water, stale water, urine deposits, sand and other foreign matter from the pores, and from the inner surfaces (via the spray heads of the bottom hanger portion) and outer surfaces (via the spray heads of the top hanger portion) of the wetsuit. After a thorough washing (if soap is used, a rinsing is also required), the water hose is disconnected and the suit left to drain and dry. Alternately, the water hose may be replaced with an air hose which delivers air, preferably warm air, through the spray heads for the quick drying of the inside, outside and interstitial material of the wetsuit.

In an alternate embodiment directed towards commercial applications of this invention, a specially constructed fiberglass washing stall is provided for housing a modified wetsuit washing and drying system wherein a plurality (e.g., four or more) of the piping systems are interconnected via a manifold, and suspended to permit the cleaning of several wetsuits simultaneously. The manifold may be valved to clean as few as one at a time.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 2:
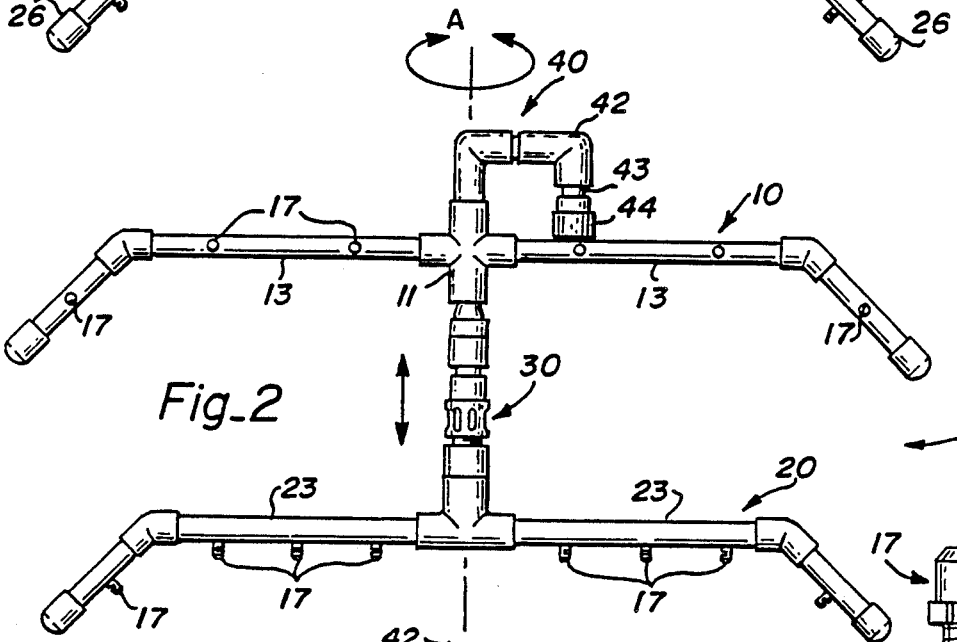

A wetsuit washing and drying (cleaning) assembly constructed in accordance with one embodiment of the present invention is indicated generally by the reference numeral 1 in FIGS. 1 and 2. The wetsuit cleaning assembly is conveniently a fluid piping structure constructed of durable light-weight plastic material, comprising a hose-connecting unit 40 connected to a top hanger portion 10 which, in turn, is disconnectably connectable to a bottom hanger portion 20 by means of a conventional quick connector/disconnector 30. The connector 30 is preferably of the automatic shut-off type so that upon disconnection, an internal valve member (e.g. a ball) shuts off the fluid flow from top arm 10 to bottom arm 20.

When described from the center and working outward, the top hanger portion 10 further comprises a four-way cross fitting 11 including a pair of opposed arms, pipes 13, connected laterally thereto and extending outwardly therefrom. The four-way cross fitting 11 also has a hose-connecting member 40 vertically fitted at its upper opening and quick connect/disconnect adapter 30 (male unit 30A) vertically fitted at its lower opening. Both the hose connecting member 40 and the quick connect adapter 30 will be described in greater detail below.

Each pipe 13 has connected at its outermost end a 45 degree downwardly bending elbow fitting 14 which, in turn, is also connected to a shorter pipe 15. End caps 16 are fitted over the outermost ends of pipe 15.

In the preferred embodiment, PVC pipe sections having an outer diameter in the range of 0.5 inch to 75 inch and having a preferred strength, such as Schedule 40 or Schedule 80 are used. A common bonding technique, utilizing PVC primer and glue, is used to connect these pipes to the plastic pipe fittings and flanges. It is understood that other materials suitable for transporting water may also be used for the piping, including but not limited to copper, galvanized metal, conduit and the like. Similarly, the piping may be connected by using threaded pipe fittings, pipe dope, teflon tape, or other like means for connecting pipes.

Figure 4:
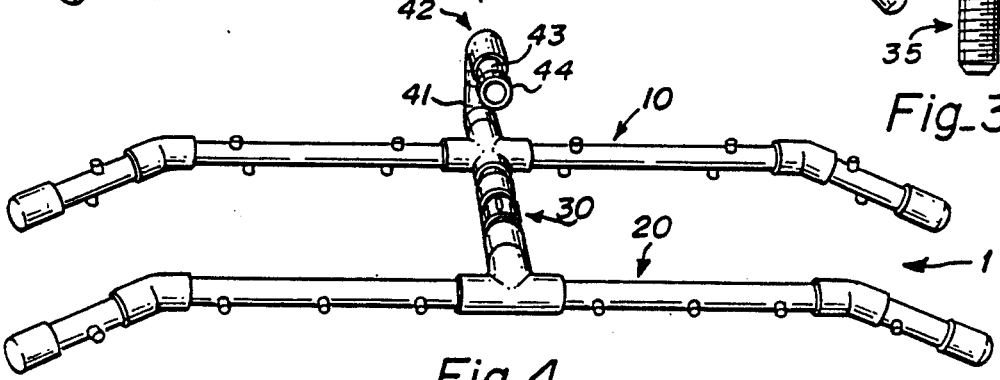
FIG. 4 is a rear perspective view of FIG. 2 from beneath the assembly.

Referring now to the pipe in cross-section, with the upper surface of the pipes 13 and 15 being the 12 o'clock position, spray nozzles 17 are disposed and spaced at regular intervals at about the 3 o'clock position (middle of the pipe in front elevation view) along the pipes 13 and 15. As best seen in FIG. 4, corresponding spray nozzles, aligned and slightly offset axially to those shown on the front, are disposed at about the 9 o'clock position (middle of the pipe as seen from a back elevation view).

While the wetsuit washer of the invention discloses pipes 15 and 13 as having 1 and 2 pairs of spray nozzles 17, respectively, spaced at regular intervals on the facing and rearward surfaces, it is understood that any greater or lesser number of spray nozzles may be used. It is also understood that the interval spacing between adjacent spray nozzles 17 and their positioning may be altered from the proscribed 3 and 9 o'clock positions so as to optimize the desired spray pattern for a particular style of wetsuit.

Figure 3:
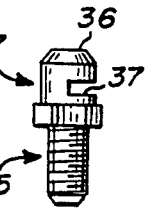
FIG. 3 is an isolated side elevation view of a single irrigation spray nozzle.

As is best seen in FIG. 3, the spray nozzle 17 is a common irrigation spray nozzle which includes a threaded portion 35, a spray head 36, and a mouth 37. The individual spray nozzles 17 are threaded or glued into the pipes 13 and 15.

Figure 5:
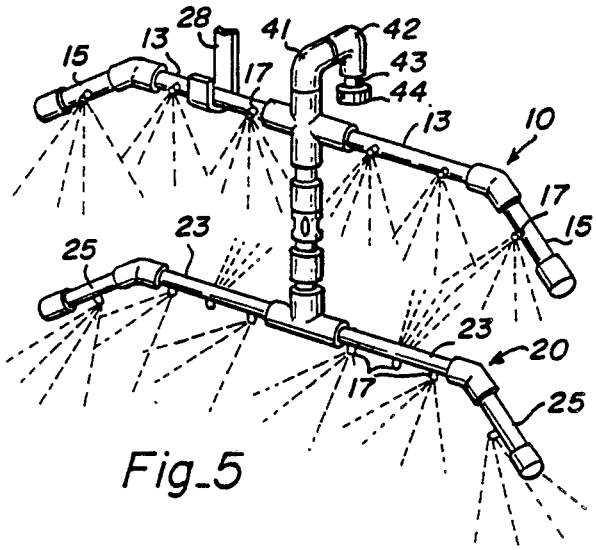
FIG. 5 is a three-quarters elevated perspective view of the first embodiment of this invention showing the orientation and location of the spray nozzles and their associated spray patterns.

Referring now to FIGS. 4 and 5, a generally U-shaped hose connecting unit 40 connects the top vertical opening of the four-way cross fitting 11 to a common garden hose or other water supply (not shown). The hose connecting unit 40 typically comprises a slip/-slip 90-degree elbow fitting 41, a slip/thread 90-degree elbow fitting 42, a threaded nipple 43 and a female hose adapter 44.

To assemble the hose connecting unit 40, one end of the slip/slip elbow fitting 41 is first primed and glued to the top opening of the four-way cross fitting The slip end of the slip/thread elbow fitting 42 is then primed and glued to the other end of the slip/slip elbow fitting 41. Attached to the threaded end of the slip/thread elbow fitting 42 is the threaded nipple 43 followed by the female hose adapter 44. The U-shape of the hose connecting unit 40 provides a hook for hanging the wetsuit washing and drying assembly 1 over a wall, bracket, door or the like while in operation, as shown in FIG. *7a*. It also facilitates the washing operation by eliminating kinks in the hose 50 (FIG. *7a*) since it hangs straight downwardly. Kinks would otherwise result in the hose if they were attached directly to the top of or horizontally from the four-way cross fitting.

FIG. 2 shows an alternate means for connecting the slip/slip elbow fitting 41 to the top of the four way cross fitting 11. The elbow fitting 41 may be rotatably secured (as shown by arrow A) to the four-way cross fitting 11 rather than being fixed by gluing. This permits greater flexibility in using the invention in confined operating areas where it may be difficult to attach a hose or hang the assembly 1.

A male hose adapter 32 connects the vertical bottom of the four way cross fitting 11 to the top 30*a* of the quick connect 30. The bottom of the quick connect 30 is connected to a female hose adapter 33, which, in turn is connected to the bottom hanger portion via the top vertical opening of tee 21.

As is best seen in FIG. 1, the quick connector 30 comprises male and female components, 30*a* and 30*b*. Common quick-connect garden hose couplings, such as the Gardena quick-connect fitting #6904 and #6917 distributed by Gardena, Inc. of Minnetonka MN, have been found to be efficient mechanisms for connecting and separating the bottom hanger portion 20 to the upper portion 10.

The structure and assembly of the bottom hanger portion 20 is similar to that of the top hanger portion 10. The side openings of the tee 21 have a pair of opposed pipes 23 connected laterally thereto and extending outwardly therefrom. Each pipe 23 has connected at its outermost end a 45 degree elbow 24 oriented downwardly, which in turn is connected to a shorter pipe segment 25. End caps 26 are fitted over the outermost ends of pipe 25.

Figure 6:
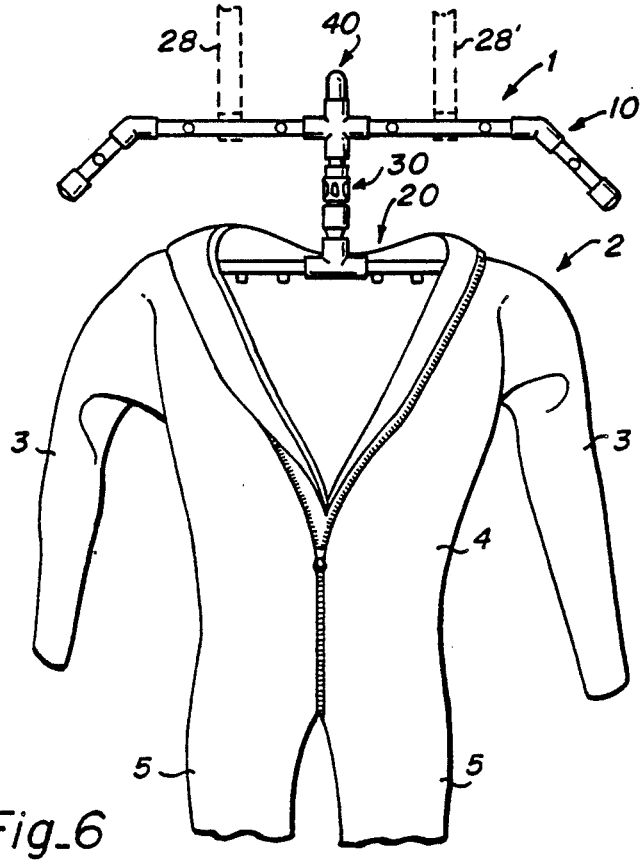
FIG. 6 is a front elevation view of a first embodiment of this invention showing a wetsuit in position to be washed and dried.

The preferred length of pipes 13 and 15 of the top hanger portion 10 is in the range of 8–12 inches and 2–5 inches, respectively, while that of the pipes 23 and 25 of the bottom hanger portion 20 is in the range of 6–10 inches and 2–5 inches, respectively. The reason for these preferred differences between the lengths of pipes 23 and 13 is best seen in FIG. 6. It desirable to have a wider top hanger portion 10 so that the spray pattern emanating outwardly therefrom during the washing and drying operation is sufficiently broad to cover and saturate the entire outside surface of the wetsuit 2. Likewise, the dimensions used for the pipes 23 of the bottom hanger portion 20 are suitable for accommodating a broad range of wetsuit shoulder widths, in addition to cooperating with the top hanger portion 10 so as to provide effective support for washing and drying. Note FIG. 6 shows the wetsuit just placed on the lower hanger assembly before it is zipped up. In FIG. *7a* it is zipped.

FIG. 5 shows the patterns of the spray emanating from nozzles 17 for both the upper and lower hanger portions 10 and 20. Referring now to the upper hanger portion 10, each of the nozzles 17 along pipes 13 and 15 are directed, to provide a vertically downward spray having an arcuate width ranging from 90–160 degrees. This spray pattern is sufficient to cover the top, front and rear outer surfaces of a wetsuit 2 when hung from the bottom hanger portion 20 (see FIG. 6), including the arms 3, torso portion 4, and legs 5 of the wetsuit 2. Note that the spray patterns corresponding to the spray nozzles 17 disposed along the rearward surfaces of pipes 13 and 15 are omitted for clarity.

In addition to their wetsuit surface area coverage capacity, the spray nozzles 17 include a specially dimensioned mouth 37 (see FIG. 3) and flow constricting throat (internal of the spray head 36) to emit a very strong spray sufficient to remove all residual salt water, stale water, urine deposits, sand and other foreign objects from the pores and surfaces of the wetsuit material. Similarly, when the spray water is mixed with the appropriate concentration of mild soap or like washing compound, bacterial and fungal growth inside the wetsuit is significantly reduced. The spray nozzles 17 are also adapted for use in dispersing forced hot air over the inner and outer surfaces of the wetsuit in a manner similar to spraying water. All the above improvements combine to provide a wetsuit washing and drying apparatus that significantly reduces premature aging and deterioration of a wetsuit, as well as quickly and efficiently preparing a comfortably dry wetsuit for its next intended use.

The operation of the wetsuit washing and drying assembly 1 of this invention will be described with reference to FIG. 6. The user first inserts the bottom hanger portion 20 into the wetsuit 2, as in the usual manner of hanging a coat on a coat hanger. Unlike common prior hose and bucket washing methods which usually washed the wetsuit with the inside folded outward so that it was washed more thoroughly (than the outside) and it was more likely to dry first when exposed to the sun or air, the wetsuit 2, when washed with this invention is cleaned thoroughly when hung either inside out or normal fashion on the bottom hanger portion 20.

Figure 7A:
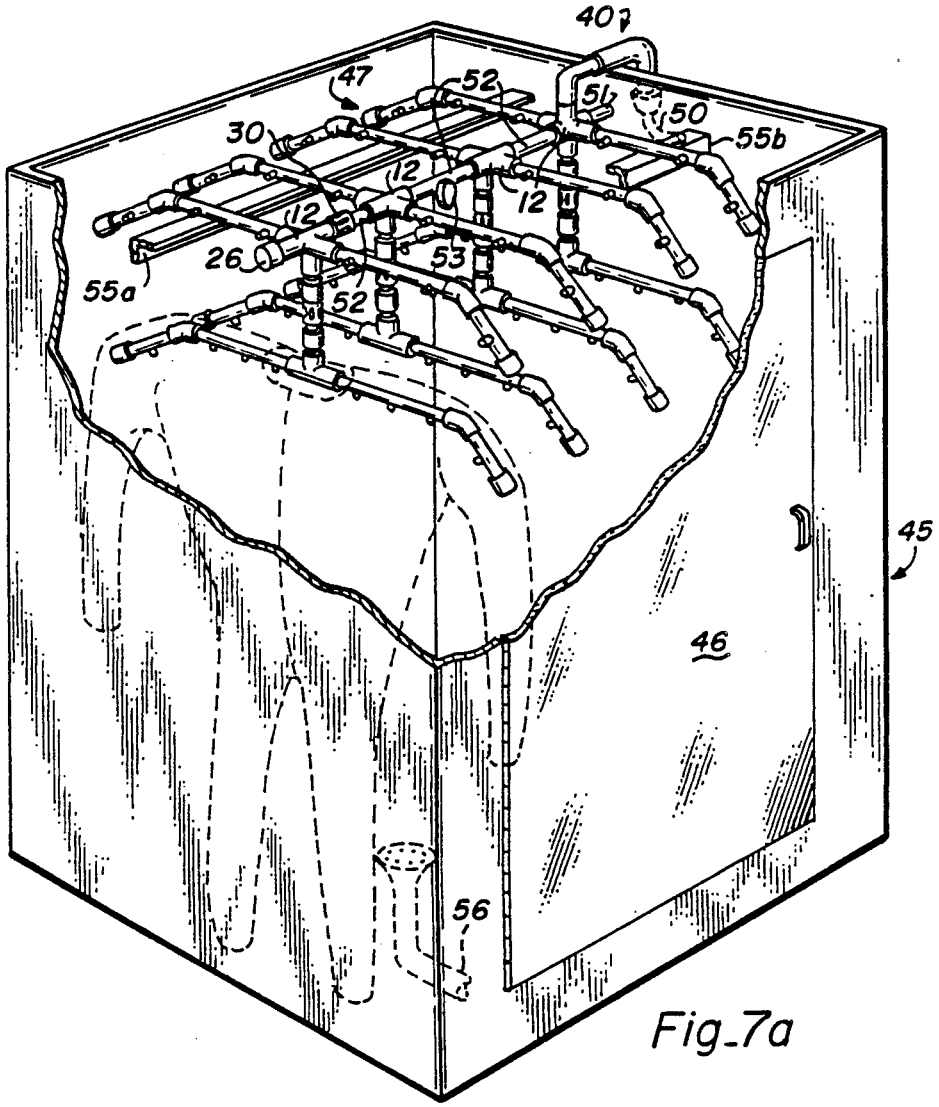
Figure 7B:
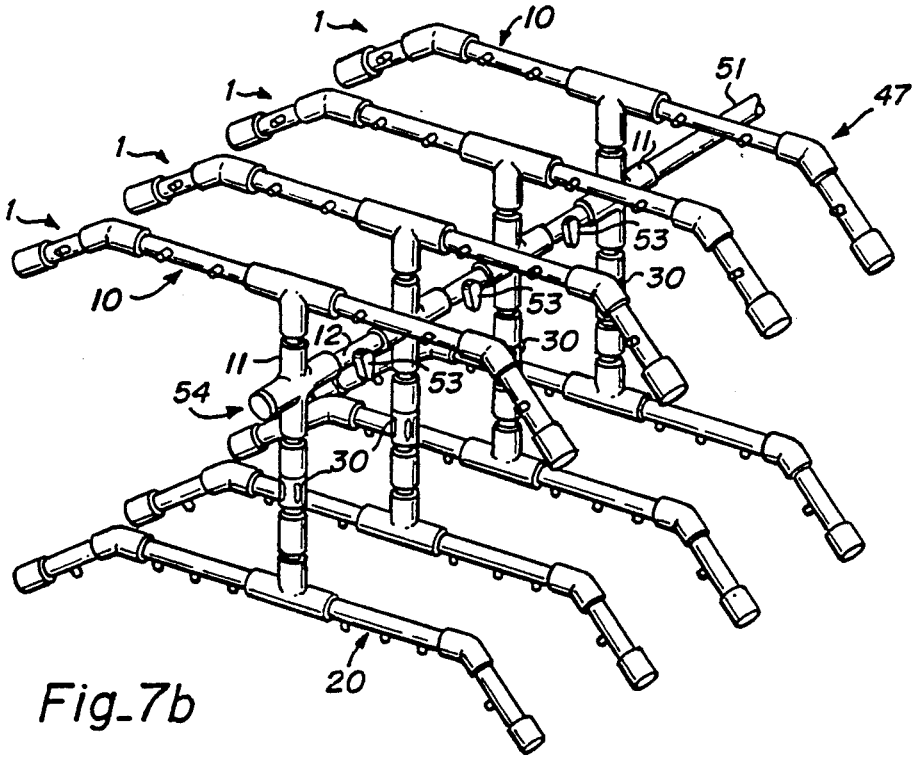

The wetsuit is then zipped up and the bottom hanger portion 20 is connected to the top hanger portion 10 by the quick connector 30. As shown in FIG. 5 and 6 the top hanger portion 10 may be suspended from a pair of laterally spaced ceiling or wall hooks, such as hook 28, 28[1]. A hose 50 (FIG. 7) from a water source is then connected to the hose connecting unit 40 and the water (and cleaning and/or antibacterial solution if desired) is turned on, resulting in the water spraying out through the spray nozzles 17. After a sufficient time, the water is turned off and the water hose is disconnected from the hose connecting unit 40 in favor of an attachable air hose (not shown). If a washing solution is used, an additional rinse cycle with fresh water is required before the air dry cycle is started.

Forced hot air is then piped through the apparatus for a time sufficient to dry the inner and outer surfaces of the entire wetsuit 2. Alternatively, if it is not necessary for the wetsuit 2 to be dried quickly, the forced air procedure may be skipped altogether. In such a case, the bottom hanger portion 20 may be disconnected and hung up to dry either outside in the sun or in a drying room. It is important to note that the bottom hanger portion 20 is adaptable for use in all conceivable wetsuit entry designs, whether they are back, shoulder or front zipper types, or pullover varieties, or combinations thereof.

As best seen in FIGS. *7a* and *7b*, an alternate embodiment of the wetsuit washing and drying apparatus of this invention may be adapted for commercial operation to handle two or more wetsuits at one time. As seen in FIG. *7a*, this is done in a first embodiment by connecting a plurality of top units in a spaced array by intermediate nipples 52 thereby connecting the additional units in series via a manifold of cross fittings 12 and nipples 52. One or more of the nipple sections 52 may contain a manual or automatic shut off valve 53, the latter of which may be a low voltage electric solenoid valve of the type used in irrigation systems so that individual or plural hanger postures may be remotely controlled, including timer controlled. Alternately, a quick connect fitting 30 may be used in place of nipple 52 (see FIG. *7a*).

The cross fittings 12, the terminal one of which is capped, and intermediate nipples 52 together comprise a manifold. The plurality of units may be supported by a pair of spaced bars 55*a*, 55*b* bridging opposed side walls of the enclosure 45. Instead of using an inverted U-shpaed hose connecting unit 40 the first of the manifolded top units (the one on the far right in FIG. *7a*) may be is plumbed horizontally directly through the side wall as shown in 51 in FIG. *7a*, and a 90° elbow directed downwardly may be used to connect to the hose or other water supply line. A suitable drain 56 is employed at the bottom of cabinet 45. The cross fitting 11 and 12 may be constructed if available fittings, or may be single piece molded plastic parts.

FIG. *7b* shows an alternate manifold system 54 comprising appropriate cross fittings 11 (or Tees 21) and nipples 12 fed by supply pipe 51. The upper ends of the cross fittings are connected to top hanger portions 10 and the lower end to bottom hanger portions 20 via quick connectors 30. Preferably valves 53 are located in the manifold lines 51 and the intermediate sections 12 between adjacent wetsuit cleaning assemblies 1.

This multiple hanger assembly is particularly useful in a commercial setting, as in a surf or dive shop operation where wetsuits are rented out and reused by different customers. The commercial embodiment may be contained within an appropriately dimensioned washing stall 45 having a closeable access door 46 to keep the washing and drying activity self contained, as well as out of sight (and out of earshot) from the rest of the store's activity.

It should be understood that various modifications within the scope of this invention can be made by one of ordinary skill in the art without departing from the spirit thereof, an example of which is the commercial embodiment of FIG. *7a* and *7b*. For example, the parts may be supplied unassembled as a kit with instructions for assembly and use. The enclosure 45 may include blowers to direct air on and/or inside the washed suits to speed drying wish our invention to be defined by the scope of the appended claims as broadly as the prior art will permit, and in view of the specification if need be.

We claim:

1. A wetsuit cleaning assembly for cleaning the inside and outside surfaces of a wetsuit, comprising in operative combination:

a) a multi-tiered structure including:

i) a first, lower tier defining a lower hanger member having a lateral dimension sufficient to support and retain a wetsuit in an upright hanging position;

ii) a second, upper tier defining an upper hanger member having a lateral dimension substantially the width of the lateral dimension of said first hanger member; and iii) a connector member disposed to transversely connect a medial portion of said lower hanger member to a medial portion of said upper hanger member, and maintain said hanger members in a vertically spaced-apart relationship;

b) said hanger members, and said connector member being hollow to permit transfer of fluid therethrough from an external source;

c) means for permitting introduction of a fluid into said hollow hanger members; and d) means for spraying said fluid being transferred throughout said hangers onto the inside and outside surfaces of a wetsuit when being supported by said lower hanger portion.

2. A wetsuit cleaning assembly as in claim 1 which includes:

a) means for connecting a hose to said multi-tiered structure via said fluid introduction means.

3. A wetsuit cleaning assembly as in claim 2 wherein:

a) said hose connecting means is adapted to eliminate kinks due to bending in a flexible hose.

4. A wetsuit cleaning assembly as in claim 3 which includes:

a) means for supporting said structure, including a wetsuit hung thereon to be cleaned, a distance above ground level sufficient to permit said wetsuit to be suspended on said lower hanger member so that wash water drains out the legs of said wetsuit.

5. A wetsuit cleaning assembly as in claim 3 wherein:

a) said hose connector comprises an invention U-shaped hose connector assembly.

6. A wetsuit cleaning assembly as in claim 1 which includes:

a) means for supporting said structure, including a wetsuit hung thereon to be cleaned, a distance above ground level sufficient to permit said wetsuit to be suspended on said lower hanger member so that wash water drains out the legs of said wetsuit.

7. A wetsuit cleaning assembly as in claim 1 wherein:

a) said connector member includes means for disconnecting said lower hanger member from said upper hanger member.

8. A wetsuit cleaning assembly system as in claim 7 wherein:

a) said multi-tiered structure is constructed of rigid plastic pipe having lateral strength sufficient to sustain the weight of a thoroughly wet wetsuit over extended use.

9. A wetsuit cleaning assembly as in claim 7 which includes:

a) at least one support member, having means for receiving said lower hanger member upon disconnect from said upper hanger member without supply of water therethrough, to permit said lower hanger having said wetsuit thereon to be removed from said upper hanger, and suspended by said disconnect portion of said lower hanger from said support member remote from said upper hanger member to permit said wetsuit to drain and dry said upper hanger.

10. A wetsuit cleaning assembly as in claim 1 wherein:

a) said hanger members terminate in plugs to close said pipes.

11. A wetsuit cleaning assembly as in claim 1 wherein:

a) said spray means are spray heads disposed to provide substantially even fluid spray coverage of said inside and said outside of said wetsuit.

12. A wetsuit cleaning assembly as in claim 11 wherein:

a) said spray heads on said lower hanger member are oriented to provide a component of substantially horizontal spray; and b) said spray heads on said upper hanger member are oriented to provide a substantial component of vertically downward spray.

13. A commercial wetsuit cleaning system comprising in operative combination:

a) a plurality of wetsuit cleaning assembly units of claim 1;

b) a manifold assembly comprising means for laterally spacing individual ones of said wetsuit cleaning assembly units apart a distance sufficient to permit ease of hanging and removal of said wetsuits on said lower hanger members; and c) means for providing a common fluid source to said manifold.

14. A commercial wetsuit cleaning system as in claim 13 wherein:

a) said connector member includes means for disconnecting said lower hanger member from said upper hanger member.

15. A commercial wetsuit cleaning system as in claim 14 wherein:

a) said manifold assembly includes at least one valve for shutting off and turning on one or more of said wetsuit cleaning assembly units.

16. A commercial wetsuit cleaning system as in claim 13 which includes:

a) means for connecting a hose to said multi-tiered structure via said fluid introduction means.

17. A commercial wetsuit system as in claim 14 which includes:

a) means for supply of water to said manifold for washing;

b) means for supply of air to said manifold for drying; and c) means for selecting which of water or air is to be supplied to said manifold.

18. A commercial wetsuit cleaning system as in claim 17 wherein:

a) said selecting means includes a valve for controlling water flow:

b) a valve for control of air flow; and c) at least one timer for permitting timed flow of said water or said air to said manifold.

19. A commercial wetsuit cleaning system as in claim 18 which includes:

a) means for providing a compound for cleaning and/or antibacterial treatment to said manifold for delivery in relation to said water.

20. A commercial wetsuit cleaning system as in claim 17 which includes:

a) means for providing a compound for cleaning and/or antibacterial treatment to said manifold for delivery in relation to said water.

21. A commercial wetsuit cleaning system as in claim 14 which includes:

a) at least one support member, having means for receiving said lower hanger member upon disconnect from said upper hanger member without supply of water therethrough, to permit said lower hanger having said wetsuit thereon to be removed from said upper hanger, and suspended by said disconnect portion of said lower hanger from said support member remote from said upper hanger member to permit said wetsuit to drain and dry on said upper hanger.

22. A commercial wetsuit cleaning assembly for cleaning the inside and outside surfaces of a wetsuit, comprising in operative combination:

a) an enclosure having at least one upstanding side wall and an entry door in said wall;

b) a commercial wetsuit cleaning system as in claim 13 disposed in said enclosure;

c) means for mounting said commercial wetsuit cleaning system in said enclosure to provide sufficient clearance above ground level below the legs of a wetsuit hung on said lower hanger member for water to drain out said legs.

23. A commercial wetsuit cleaning assembly as in claim 22 wherein:

a) said connector member includes means for disconnecting said lower hanger member from said upper hanger member.

24. A commercial wetsuit cleaning assembly as in claim 23 wherein:

a) said spray means are spray heads disposed to provide substantially even fluid spray coverage of said inside and said outside of said wetsuit.

25. A commercial wetsuit cleaning assembly as in claim 24 wherein:

a) said manifold assembly includes at least one valve for shutting off and turning on one or more of said wetsuit cleaning assembly units.

26. A commercial wetsuit cleaning assembly as in claim 24 wherein:

a) means for supply of water to said manifold for washing;

b) means for supply of air to said manifold for drying; and c) means for selecting which of water or air is to be supplied to said manifold.

27. A commercial wetsuit cleaning assembly as in claim 26 wherein:

a) said selecting means includes a valve for controlling water flow:

b) a valve for control of air flow; and c) at least one timer for permitting timed flow of said water or said air to said manifold.

28. A commercial wetsuit cleaning assembly as in claim 27 which includes:

a) means for providing a compound for cleaning and/or antibacterial treatment to said manifold for delivery in relation to said water.

29. A commercial wetsuit cleaning assembly as in claim 23 which includes:

a) at least one support member, having means for receiving said lower hanger member upon disconnect from said upper hanger member without supply of water therethrough, to permit said lower hanger having said wetsuit thereon to be removed from said upper hanger, and suspended by said disconnect portion of said lower hanger from said support member remote from said upper hanger member to permit said wetsuit to drain and dry on said upper hanger.

30. A commercial wetsuit cleaning assembly as in claim 22 wherein:

a) said enclosure is polygonal.

31. A commercial wetsuit cleaning assembly as in claim 30 wherein:

a) said enclosure is modular; and which includes:

b) a base member to which said enclosure walls are mounted; and c) said base member includes a drain.

* * * * *